US005221498A

United States Patent [19]

Reid et al.

[11] Patent Number: 5,221,498

[45] Date of Patent: Jun. 22, 1993

[54] METHODS AND COMPOSITIONS FOR INHIBITORING POLYMERIZATION OF VINYL MONOMERS

[75] Inventors: Dwight K. Reid, Houston; Rosalie B. Hart, The Woodlands, both of Tex.

[73] Assignee: Betz Laboratories, Inc., Trevose, Pa.

[21] Appl. No.: 733,480

[22] Filed: Jul. 22, 1991

[51] Int. Cl.[5] ..... C10G 57/02

[52] U.S. Cl. ..... 252/403; 208/48 R; 208/48 AA

[58] Field of Search ..... 252/401, 403, 404; 208/48 R, 48 AA

[56] References Cited

U.S. PATENT DOCUMENTS

| | | | |
|---|---|---|---|
| 2,329,251 | 9/1943 | Chenicek | 44/66 |
| 4,011,057 | 3/1977 | Sayers | 44/52 |
| 4,296,020 | 10/1981 | Magrans, Jr. | 525/28 |
| 4,375,006 | 2/1983 | Jackisch | 252/404 X |
| 4,456,526 | 6/1984 | Miller et al. | 208/48 |
| 4,468,343 | 8/1984 | Butler et al. | 252/403 |
| 4,697,290 | 3/1987 | Reid | 44/57 |
| 4,744,881 | 3/1988 | Reid | 208/48 AA |
| 4,804,956 | 2/1989 | Forester | 208/48 AA |
| 4,810,354 | 3/1989 | Roling et al. | 208/48 AA |
| 4,867,754 | 9/1989 | Reid | 44/72 |
| 4,912,247 | 3/1990 | Roling | 558/306 |
| 4,927,561 | 5/1990 | Forester | 252/389.22 |
| 4,929,778 | 5/1990 | Roling | 585/3 |
| 5,023,372 | 6/1991 | Roling | 562/598 |
| 5,039,391 | 8/1991 | Reid et al. | 208/48 AA |
| 5,045,233 | 9/1991 | Kita et al. | 252/399 |
| 5,068,271 | 11/1991 | Wheeler et al. | 524/100 |

*Primary Examiner*—Robert L. Stoll
*Assistant Examiner*—Valerie D. Fee
*Attorney, Agent, or Firm*—Alexander D. Ricci; Philip H. Von Neida

[57] ABSTRACT

Methods and compositions are provided for inhibiting the polymerization of a vinyl monomer during elevated processing thereof or during storage or shipment of the monomer containing product. The compositions comprise a combination of a dihydroxybenzene compound and an organic amine compound.

9 Claims, No Drawings

METHODS AND COMPOSITIONS FOR INHIBITORING POLYMERIZATION OF VINYL MONOMERS

FIELD OF THE INVENTION

This invention relates to methods and compositions for inhibiting the undesired polymerization of vinyl monomers and subsequent fouling of heat exchangers in refinery and petrochemical processing systems.

BACKGROUND OF THE INVENTION

Fouling can be defined as the accumulation of unwanted matter on heat transfer surfaces. This deposition can be very costly in refinery and petrochemical plants since it increases fuel usage, results in interrupted operations and production losses and increases maintenance costs.

Deposits are found in a variety of equipment: preheat exchangers, overhead condensers, furnaces, heat exchangers, fractionating towers, reboilers, compressors and reactor beds. These deposits are complex but they can be broadly characterized as organic and inorganic. They consist of metal oxides and sulfides, soluble organic metals, organic polymers, coke, salt and various other particulate matter.

The chemical composition of organic foulants is rarely identified completely. Organic fouling is caused by insoluble polymers which sometimes are degraded to coke. The polymers are usually formed by reactions of unsaturated hydrocarbons, although any hydrocarbon can polymerize. Generally, olefins tend to polymerize more readily than aromatics, which in turn polymerize more readily than paraffins. Trace organic materials containing Hetero atoms such as nitrogen, oxygen and sulfur also contribute to polymerization.

Polymers are generally formed by free radical chain reactions. These reactions, shown below, consist of two phases, an initiation phase and a propagation phase. In Reaction 1, the chain initiation reaction, a free radical represented by R., is formed (the symbol R· can be any hydrocarbon). These free radicals, which have an odd electron, act as chain carriers. During chain propagation, additional free radicals are formed and the hydrocarbon molecules (R) grow larger and larger (see Reaction 4), forming the unwanted polymers which accumulate on heat transfer surfaces.

Chain reactions can be triggered in several ways. In Reaction 1, heat starts the chain. Example: When a reactive molecule such as an olefin or a diolefin is heated, a free radical is produced. Another way a chain reaction starts is shown in Reaction 3. Metal ions initiate free radical formation here. Accelerating polymerization by oxygen and metals can be seen by reviewing Reactions 2 and 3.

As polymers form, more polymers begin to adhere to the heat transfer surfaces. This adherence results in dehydrogenation of the hydrocarbon and eventually the polymer is converted to coke.

1. Chain Initiation $$R-H \rightarrow R\cdot + H\cdot$$

2. Chain Propagation a. $R\cdot + O_2 \rightarrow R-O-O\cdot$ b. $R-O-O\cdot + R'-H \rightarrow R\cdot + R-O-O-H$ c. $R'\cdot + C=C \rightarrow R'-C-C \rightarrow \text{Polymer}$ 3. Chain Initiation a. $Me^{++} + RH \rightarrow Me^{+}R\cdot + H^{+}$ b. $Me^{++} + R-O-O-H \rightarrow Me^{+}R-O-O\cdot + H^{+}$ 4. Chain Termination a. $R\cdot + R \rightarrow R-R'$ b. $R\cdot + R-O-O \rightarrow R-O-O-R$ In refineries, deposits usually contain both organic and inorganic compounds. This makes the identification of the exact cause of fouling extremely difficult. Even if it were possible to precisely identify every single deposit constituent, this would not guarantee uncovering the cause of the problem. Assumptions are often erroneously made that if a deposit is predominantly a certain compound, then that compound is the cause of the fouling. In reality, oftentimes a minor constituent in the deposit could be acting as a binder, a catalyst, or in some other role that influences actual deposit formation.

The final form of the deposit as viewed by analytical chemists may not always indicate its origin or cause. Before openings, equipment is steamed, water-washed, or otherwise readied for inspection. During this preparation, fouling matter can be changed both physically and chemically. For example, water-soluble salts can be washed away or certain deposit constituents oxidized to another form.

In petrochemical plants, fouling matter is often organic in nature. Fouling can be severe when monomers convert to polymers before they leave the plant. This is most likely to happen in streams high in ethylene, propylene, butadiene, styrene and other unsaturates. Probable locations for such reactions include units where the unsaturates are being handled or purified, or in streams which contain these reactive materials only as contaminants.

Even through some petrochemical fouling problems seem similar, subtle differences in feedstock, processing schemes, processing equipment and type of contaminants can lead to variations in fouling severity. For example, ethylene plant depropanizer reboilers experience fouling that appears to be primarily polybutadiene in nature. The severity of the problem varies significantly from plant to plant, however. The average reboiler run length may vary from one to two weeks up to four to six months (without chemical treatment).

Although it is usually impractical to identify the fouling problem by analytical techniques alone, this information combined with knowledge of the process, processing conditions and the factors known to contribute to fouling, are all essential to understanding the problem.

There are many ways to reduce fouling both mechanically and chemically. Chemical additives often offer an effective anti-fouling means; however, processing changes, mechanical modifications equipment and other methods available to the plant should not be overlooked.

Antifoulant chemicals are formulated from several materials: some prevent foulants from forming, others prevent foulants from depositing on heat transfer equipment. Materials that prevent deposit formation include antioxidants, metal coordinators and corrosion inhibitors. Compounds that prevent deposition are surfactants which act as detergents or dispersants.

Different combinations of these properties are blended together to maximize results for each different application. These "poly-functional" antifoulants are generally more versatile and effective since they can be designed to combat various types of fouling that can be present in any given system.

Research indicates that even very small amounts of oxygen can cause or accelerate polymerization. Accordingly, anti-oxidant-type antifoulants have been developed to prevent oxygen from initiating polymerization. Antioxidants act as chain-stoppers by forming inert molecules with the oxidized free radical hydrocarbons, in accordance with the following reaction:

Chain Termination

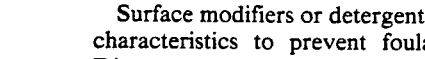

$$ROO\cdot Antioxidant \rightarrow ROOH + Antioxidant\ (H)$$

Surface modifiers or detergents change metal surface characteristics to prevent foulants from depositing. Dispersants or stabilizers prevent insoluble polymers, coke and other particulate matter from agglomerating into large particles which can settle out of the process stream and adhere to the metal surfaces of process equipment. They also modify the particle surface so that polymerization cannot readily take place.

Antifoulants are designed to prevent equipment surfaces from fouling. They are not designed to clean up existing foulants. Therefore, an antifoulant should be started immediately after equipment is cleaned. It is usually advantageous to pretreat the system at double the recommended dosage for two or three weeks to reduce the initial high rate of fouling immediately after startup.

The increased profit possible with the use of antifoulants varies from application to application. It can include an increase in production, fuel savings, maintenance savings and other savings from greater operating efficiency.

There are many areas in the hydrocarbon processing industry where antifoulants have been used extensively; the main areas of treatment are discussed below.

In a refinery, the crude unit has been the focus of attention because of increased fuel costs. Antifoulants have been successfully applied at the exchangers; downstream and upstream of the desalter, on the product side of the preheat train, on both sides of the desalter makeup water exchanger and at the sour water stripper.

Hydrodesulfurization units of all types experience preheat fouling problems. Among those that have been successfully treated are reformer pretreaters processing both straight run and coker naphtha, desulfurizers processing catalytically cracked and coker gas oil, and distillate hydro-treaters. In one case, fouling of a Unifiner stripper column was solved by applying a corrosion inhibitor upstream of the problem source.

Unsaturated and saturated gas plants (refinery vapor recovery units) experience fouling in the various fractionation columns, reboilers and compressors. In some cases, a corrosion control program combined with an antifoulant program gave the best results. In other cases, an application of antifoulants alone was enough to solve the problem.

Cat cracker preheat exchanger fouling, both at the vacuum column and at the cat cracker itself, has also been corrected by the use of antifoulants.

The two most prevalent areas for fouling problems in petrochemical plants are at the ethylene and styrene plants. In an ethylene plant, the furnace gas compressors, the various fractionating columns and reboilers are subject to fouling. Polyfunctional antifoulants, for the most part, have provided good results in these areas. Fouling can also be a problem at the butadiene extraction area. Both antioxidants and polyfunctional antifoulants have been used with good results.

In the different design butadiene plants, absorption oil fouling and distillation column and reboiler fouling have been corrected with various types of antifoulants.

Chlorinated hydrocarbon plants, such as VCM, EDC and perchloroethane and tri-chloroethane have all experienced various types of fouling problems. The metal coordinating/antioxidant-type antifoulants give excellent service in these areas.

SUMMARY OF THE INVENTION

The present invention provides for polymerization inhibiting compositions comprising an organic amine compound and a dihydroxybenzene compound.

The present invention further provides for methods for inhibiting the polymerization of vinyl monomers during the processing of hydrocarbons. The use of an organic amine and a dihydroxybenzene compound will inhibit the formation of polymers and will inhibit the fouling of heat transfer surfaces in contact with the hydrocarbon being processed.

DESCRIPTION OF THE RELATED ART

U.S. Pat. No. 4,744,881 (Reid) teaches the use of a composition of an unhindered or hindered phenol and a strongly basic amine compound to control fouling in hydrocarbon fluids having a bromine number greater than 10. This patent discloses N-(2-aminoethyl) piperazine as one of the amines that can be utilized in the process.

U.S. Pat. No. 2,329,251, (Chenicek) teaches an early method of inhibiting gum formation in hydrocarbon distillates using an alkylene polyamine salt of an organic acid.

U.S. Pat. No. 4,647,290 (Reid) teaches the use of a composition of N-(2-aminoethyl) piperazine and N,N-diethylhydroxylamine to inhibit color deterioration of distillate fuel oils. The combination of these two chemicals provide a more effective color stabilized composition than when either is used alone.

U.S. Pat. No. 4,867,754 (Reid) teaches the use of a composition of a phosphite compound and an organic compound containing a tertiary amine of the formula $T_3N$ to stabilize distillate fuel oils. 2-(aminoethyl) piperazine is disclosed as one of the possible amines used. This combination provides a higher degree of stabilization of distillate fuel oil than when the individual species are used alone.

U.S. Pat. No. 4,011,057 (Sayers) discloses an antioxidant composition especially for gasoline. The composition comprises a hindered phenol and an amino compound having a $pK_b$ of from about 0.3 to 8.0.

U.S. Pat. No. 4,456,526 (Miller et al.) discloses an antifoulant composition and method for inhibiting fouling in petroleum processing equipment. The composition comprises 10 to 90 weight percent of an N,N-dialkylhydroxylamine compound having alkyl groups from 2 to 10 carbon atoms and 90 to 10 weight percent of a tertiary-alkyl catechol having 4 to 20 alkyl carbon atoms in an inert solvent.

U.S. Pat. No. 4,929,778 (Roling) discloses a composition and method for inhibiting polymerization of styrene monomer during its processing or shipment. The composition which can inhibit fouling of processing equipment comprises a phenylenediamine compound and a hindered phenol compound.

U.S. Pat. No. 4,810,354 (Roling et al.) discloses a method of inhibiting fouling in a hydrocarbon by deactivating transition metal impurities in the hydrocarbon. This method employs adding an alkoxylated Mannich product formed by reacting an alkoxylated phenol, a polyamine and an aldehyde.

U.S. Pat. No. 4,804,456 (Forester) discloses an antifouling treatment for petroleum hydrocarbons. The treatment comprises adding to the hydrocarbon an amine salt of polyalkenylthiophosphonic acid. The amines of the present invention could be used to react with the acid to form the amine salt.

DETAILED DESCRIPTION OF THE INVENTION

The present invention pertains to methods and compositions for inhibiting the polymerization of vinyl monomers during the processing of hydrocarbons. The polymerization inhibiting composition is a combination of an organic amine and a dihydroxybenzene compound.

The phrase "vinyl monomers" as herein used is intended to include compounds having the vinyl grouping including, for instance, styrene, methyl methacrylate, and acrylonitrile.

The dihydroxybenzene compounds have the formula

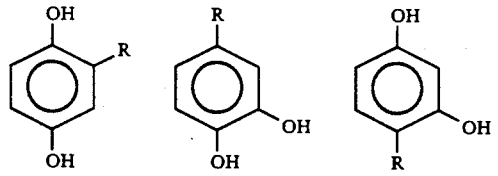

wherein R is H, alkyl or aryl.

Exemplary dihydroxybenzene compounds include, but are not limited to, hydroquinone, tert-butyl hydroquinone, tert-butyl catechol and resorcinol.

The organic amines generally have the formula $NR_2R_3R_4$ where $R_2$, $R_3$ and $R_4$ are hydrogen, alkyl, aryl, ethyleneamine, diethylenediamine or polyoxypropylene amine with the proviso that one of $R_2$, $R_3$ or $R_4$ is one of the enumerated amine groups. or in any combination thereof. Exemplary amines include polyoxypropylenediamine, diethylenetriamine, ethylenediamine and triethylenetetramine.

The treatment range for the composition, i.e., amine/dihydroxybenzene, clearly depends upon the severity of the fouling problem due to free radical polymerization encountered as well as the activity and constituency of the combination utilized. For this reason, the success of the treatment is totally dependent upon the use of a sufficient amount of the purpose of whatever the composition of choice is. Broadly speaking, the treatment recommended could be in a range from about 1 part per million to about 5000 parts per million of the hydrocarbon being processed. Preferably a range from about 5 parts per million to about 100 parts per million of hydrocarbon is employed.

The amount by weight (active) of the amine to the dihydroxybenzene ranges from 0.001% to 0.5% and preferably is 0.0025% to 0.005% of the total treatment.

The weight ratio of the components is 60 to 40% amine compound to 40 to 60% dihydroxybenzene compound. Preferably, the weight ratio is 60% amine compound and 40% dihydroxybenzene compound. A preferred embodiment employs 60% by weight diethylenetriamine and 40% hydroquinone.

The method of the present invention can control the fouling of processing equipment, such as the equipment used in separation and purification processes by vinyl monomers, which is due to or caused by the polymerization of the monomer. The instant invention may be used as both a process inhibitor, which is employed during preparation and processing (e.g., employing heat) of the vinyl monomer, and as a product inhibitor, which is combined with the monomer in order to inhibit polymerization during storage and handling.

The dihydroxybenzene compound and organic amine can be added to the vinyl monomer by any conventional method. The components can be added to the monomer as a single composition containing the inhibitor compounds or- the individual components can be added separately or in any other desired combination. The composition may be added as either a dispersion or as a solution using a suitable liquid carrier dispersing medium or solvent which is compatible with the monomer. Preferably, a solution is provided and the solvent is a non-polar organic solvent such as xylene (a commercial mixture of o, m and p isomers), or heavy aromatic naphtha.

The data set forth below were developed to demonstrate the unexpected results occasioned by use of the invention. The following examples are included as being illustrations of the invention and should not be construed as limiting the scope thereof.

DETAILED DESCRIPTION OF THE PREFERRED EMBODIMENT

Vapor Phase Apparatus Test

The vapor phase apparatus consists of a syringe pump that injects the monomer at a fixed rate into a vaporization tube. The vaporization tube is 18 inches long and has a one-quarter of an inch inside diameter. This stainless steel tube is heated to 350° to 450° F. (at least 70° F. above the boiling point of the monomer).

20 ml of styrene monomer is injected uniformly over a period of 15 minutes into this 11 ml capacity tube (a residence time of 8 minutes was calculated) in which time the liquid reached vaporization temperatures.

A 4 inch long by one-quarter inch inside diameter steel tube containing 0.5 g of steel wool, called a demister, is placed at the end of the vaporization tube to prevent any liquid droplets from entraining into the deposition tube. The deposition tube consists of a 12 inch long by one-quarter inch inside diameter stainless steel tube containing 4.5 g of packed steel wool. The deposition tube is weighed before and after each test to measure the amount of polymer formed.

The vaporization tube and deposition tube are wrapped separately with heating tapes which were controlled at specific voltages. Thermocouples wrapped in the heating tapes were used to record the temperatures on the outside tube surfaces. Results are reported in Table I.

TABLE I

| Treatment (1000 ppm) | Deposit (mg) |
|---|---|
| A | 248.0 |
| A | 217.0 |
| B | 299.0 |
| B | 415.0 |
| C | 1200.0 |
| C | 793.0 |
| C | 994.0 |
| D | 256.0 |
| E | 8.2 |
| E | 3.2 |
| F | 411.0 |
| F | 809.0 |
| F | 849.0 |
| B/F | 2.1 |
| B/F | 6.9 |
| B/F | 5.7 |
| G | 356.0 |
| G | 588.0 |
| G | 538.0 |
| Blank | 1300.0 |
| Blank | 1600.0 |
| Blank | 1300.0 |
| Blank | 1100.0 |

A = Amine succinimide dispersant
B = Polyoxypropylenediamine
C = DEHA = diethylhydroxylamine
D = Diethylenetriamine
E = DNOC = 4,6-dinitrocreosol
F = Hydroquinone
G = Triethylenetetramine It can be seen from Table I that the dihydroxybenzene/amine combination (i.e., B/F), specifically hydroquinone and polyoxypropylenediamine, proved more efficacious as an antifoulant composition than those used in the art.

Due to the unexpected results shown by the combination of dihydroxybenzene compound and organic amine, it is possible to produce a more effective monomer polymerization inhibiting treatment than is obtainable by either ingredient alone when measured at comparable treatment levels. This enhanced inhibition activity of the mixture allows the concentration of each ingredient to be lowered and the total quantity of the polymerization inhibitor required for an effective treatment at elevated temperatures may be reduced. This factor is especially important in monomer purification procedures where the obvious goal of the process is to provide high level monomer purity.

The term "elevated temperatures" as used herein means temperatures of from about 100° to 300° F. that are commonly encountered during the heat treatment of vinyl monomers. Such heat treatment procedures include distillation and various other processes.

While this invention has been described with respect to particular embodiments thereof, it is apparent that numerous other forms and modifications will be obvious to those skilled in the art. The appended claims should be construed to cover all such obvious forms and modifications which are within the true spirit and scope of the present invention.

Having thus described the invention what we claim is:

1. A vinyl monomer polymerization inhibiting composition in refinery and petrochemical systems consisting essentially of a dihydroxybenzene compound selected from the group consisting of

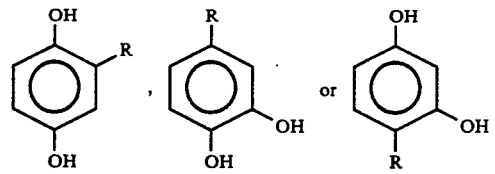

wherein R is H, alkyl or aryl group having from 1 to 5 carbon atoms and an organic amine compound selected from the group consisting of polyoxypropylenediamine, and diethylenetriamine.

2. The composition as claimed in claim 1 wherein said dihydroxybenzene compound is hydroquinone.

3. The composition as claimed in claim 1 wherein said dihydroxybenzene and said organic amine compound are dissolved in a non-polar organic solvent.

4. The composition as claimed in claim 1 wherein the weight ratio of said dihydroxybenzene compound to said organic amine compound is 40 to 60%:60 to 40%.

5. A method for inhibiting the polymerization of vinyl monomer compounds in refinery and petrochemical systems consisting essentially of adding to said vinyl monomer compound and effective inhibiting amount of (a) a dihydroxybenzene compound selected from the group consisting of

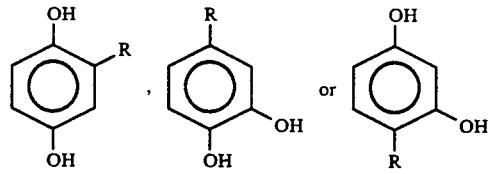

and (b) an organic amine compound selected from the group consisting of polyoxypropylenediamine, and diethylenetriamine.

6. The method as claimed in claim 5 wherein said dihydroxybenzene compound is hydroquinone.

7. The method as claimed in claim 5 comprising adding to said vinyl monomer compound from about 1 to about 5000 parts of said polymerization inhibitor per million parts of said vinyl monomer compound.

8. The method as claimed in claim 7 comprising adding to said vinyl monomer compound from about 5 to about 100 parts of said polymerization inhibitor per million parts of said vinyl monomer compound.

9. The method as claimed in claim 5 wherein said dihydroxybenzene compound and said organic amine compound are dissolved in a non-polar organic solvent.

* * * * *